US010566130B2

(12) United States Patent
Bong et al.

(10) Patent No.: US 10,566,130 B2
(45) Date of Patent: Feb. 18, 2020

(54) COIL COMPONENT AND METHOD OF MANUFACTURING SAME

(71) Applicant: SAMSUNG ELECTRO-MECHANICS CO., LTD., Suwon-si, Gyeonggi-do (KR)

(72) Inventors: Kang Wook Bong, Suwon-si (KR); Boum Seock Kim, Suwon-si (KR); Jae Hun Kim, Suwon-si (KR); Jong Sik Yoon, Suwon-si (KR); Byeong Cheol Moon, Suwon-si (KR)

(73) Assignee: Samsung Electro-Mechanics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 16/548,147

(22) Filed: Aug. 22, 2019

(65) Prior Publication Data

US 2019/0378644 A1 Dec. 12, 2019

Related U.S. Application Data

(63) Continuation of application No. 15/487,987, filed on Apr. 14, 2017.

(30) Foreign Application Priority Data

Jul. 14, 2016 (KR) ..... 10-2016-0089438

(51) Int. Cl.
*H01F 5/00* (2006.01)
*H01F 27/28* (2006.01)
(Continued)

(52) U.S. Cl.
CPC ..... *H01F 27/2804* (2013.01); *H01F 27/255* (2013.01); *H01F 27/292* (2013.01);
(Continued)

(58) Field of Classification Search
USPC ..... 336/200, 232, 192, 83
See application file for complete search history.

(56) References Cited

U.S. PATENT DOCUMENTS

2004/0164835 A1 8/2004 Shoji
2006/0152321 A1* 7/2006 Jung ..... H01F 17/0006 336/200
(Continued)

FOREIGN PATENT DOCUMENTS

CN 1523617 A 8/2004
CN 1801412 A 7/2006
(Continued)

OTHER PUBLICATIONS

Office Action issued in Chinese Application No. 201710406411.4 dated Jul. 31, 2019, with English translation.
(Continued)

*Primary Examiner* — Elvin G Enad
*Assistant Examiner* — Kazi S Hossain
(74) *Attorney, Agent, or Firm* — Morgan, Lewis & Bockius LLP

(57) ABSTRACT

A coil component includes an insulating layer having a coil shape, first and second coil conductor layers on opposing surfaces of the insulating layer, each having a coil shape corresponding to that of the insulating layer, and an encapsulant encapsulating the insulating layer and the first and second coil conductor layers.

9 Claims, 6 Drawing Sheets

(51) Int. Cl.

| | |
|---|---|
| ***H01F 27/255*** | (2006.01) |
| ***H01F 27/32*** | (2006.01) |
| ***H01F 41/04*** | (2006.01) |
| ***H01F 27/29*** | (2006.01) |

(52) U.S. Cl.
CPC ..... *H01F 27/323* (2013.01); *H01F 41/041* (2013.01); *H01F 2027/2809* (2013.01)

(56) References Cited

U.S. PATENT DOCUMENTS

| | | | | |
|---|---|---|---|---|
| 2015/0048918 | A1 | 2/2015 | Park et al. | |
| 2015/0061813 | A1* | 3/2015 | Kim ..... | H01F 27/2804 336/200 |
| 2015/0340150 | A1 | 11/2015 | Nakamura et al. | |
| 2016/0268040 | A1* | 9/2016 | Kim ..... | H01F 17/0013 |

FOREIGN PATENT DOCUMENTS

| | | | |
|---|---|---|---|
| JP | 2004-253684 | A | 9/2004 |
| JP | 2008-251590 | A | 10/2008 |
| JP | 2016-001715 | A | 1/2016 |
| KR | 10-2014-0137306 | A | 12/2014 |
| KR | 10-2015-0019588 | A | 2/2015 |
| WO | 2007/004483 | A1 | 1/2007 |

OTHER PUBLICATIONS

Office Action issued in corresponding Korean Patent Application No. 10-2016-0089438, dated Jul. 20, 2017.
Office Action issued in Japanese Patent Application No. 2017-080948, dated Feb. 13, 2018.
Office Action issued in corresponding Chinese Application No. 201710406411.4, dated Mar. 27, 2019.

* cited by examiner

COIL COMPONENT AND METHOD OF MANUFACTURING SAME

CROSS-REFERENCE TO RELATED APPLICATION(S)

This application is a Continuation Application of U.S. patent application Ser. No. 15/487,987, filed Apr. 14, 2017, which claims benefit of priority to Korean Patent Application No. 10-2016-0089438, filed Jul. 14, 2016, the disclosures of each of which are incorporated herein by reference in their entireties.

BACKGROUND

1. Field

The present disclosure relates to a coil component and a method of manufacturing the same.

2. Description of Related Art

An inductor, a coil component, is a passive element that can be included in an electronic circuit together with a resistor and a capacitor to remove noise.

Inductors may include winding type inductors, multilayer inductors, thin film type inductors, and the like. A thin film type inductor can be manufactured to be relatively thin and has recently been utilized in various fields.

In existing thin film type inductors, a coil conductor is formed on an insulating substrate, which can limit the reduction of overall thickness of the coil component.

SUMMARY

An aspect of the present disclosure may provide a coil component having a significantly reduced thickness, and a method of manufacturing the same.

According to an aspect of the present disclosure, a coil component may be provided, in which a thickness of a coil part is reduced by forming the coil part by a coreless method used to manufacture a printed circuit board.

According to an aspect of the present disclosure, a coil component may include an insulating layer having a coil shape, first and second coil conductor layers on opposing surfaces of the insulating layer, each having a coil shape corresponding to that of the insulating layer, and an encapsulant encapsulating the insulating layer and the coil conductor layers.

According to another aspect of the present disclosure, a method of manufacturing a coil component may include: preparing a support member, forming a first mask on the support member, the first mask having an opening pattern with a coil shape, forming a first coil conductor layer in the opening pattern of the first mask, forming an insulating layer on the first coil conductor layer, separating the first coil conductor layer from the support member, removing the first mask and regions of the insulating layer corresponding to the first mask, and forming an encapsulant encapsulating the insulating layer and the first coil conductor layer.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, a coil component according to an exemplary embodiment in the present disclosure will be described, and an inductor will be described as an example of the coil component for convenience. However, the present disclosure is not limited thereto, but may also be applied to other coil components for various purposes. An example of other coil components for various purposes may include a common mode filter, a general bead, a high frequency (GHz) bead, and the like.

Figure 1:
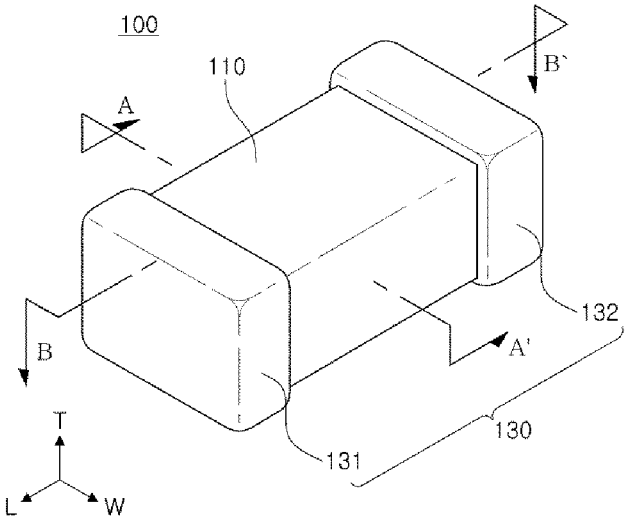
FIG. 1 is a perspective view illustrating a coil component according to an exemplary embodiment in the present disclosure.
Figure 2:
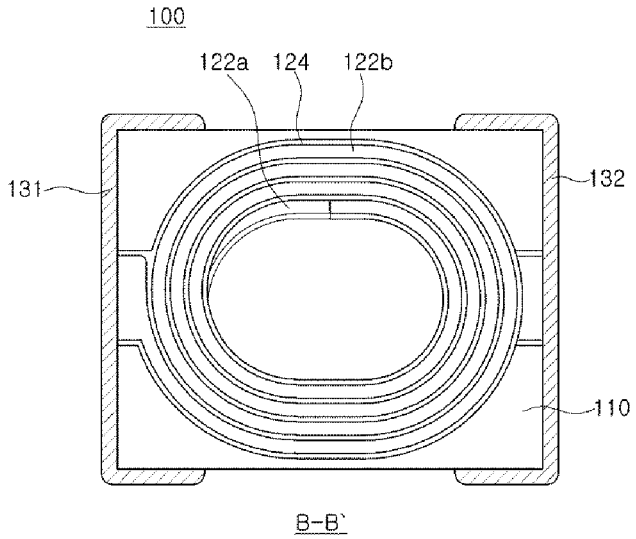
FIG. 2 is is a cross-sectional view taken along line B-B' of the coil component of FIG. 1.
Figure 3:
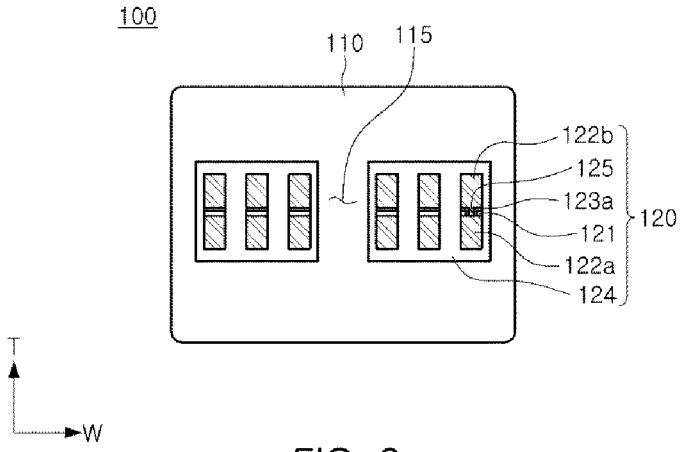
FIG. 3 is a cross-sectional view taken along line A-A' of the coil component of FIG. 1.

FIG. 1 is a perspective view illustrating a coil component according to an exemplary embodiment in the present disclosure. FIG. 2 is is a cross-sectional view taken along line B-B' of the coil component of FIG. 1. FIG. 3 is a cross-sectional view taken along line A-A' of the coil component of FIG. 1. In the following description provided with reference to FIG. 1, a 'length' direction refers to an 'L' direction of FIG. 1, a 'width' direction refers to a 'W' direction of FIG. 1, and a 'thickness' direction refers to a 'T' direction of FIG. 1.

Referring to FIGS. 1, 2 and 3, a coil component 100 according to an exemplary embodiment in the present disclosure may include a body part 110, a coil part 120, and an electrode part 130.

The body part 110 may form an exterior of the coil component 100. The body part 110 may have an approximately hexahedral shape having end surfaces opposing each other in the length direction, side surfaces opposing each other in the width direction, and upper and lower surfaces opposing each other in the thickness direction. However, the shape of body part 110 is not limited thereto.

The body part 110 may include a magnetic material. The magnetic material is not particularly limited as long as it has magnetic properties, but may be, for example, iron or iron alloys such as a pure iron powder, alloy powders that are Fe—Si-based, Fe—Si—Al-based, Fe—Ni-based, Fe—Ni—Mo-based, Fe—Ni—Mo—Cu-based, Fe—Co-based, Fe—Ni—Co-based, Fe—Cr-based, Fe—Cr—Si-based, Fe—Ni—Cr-based, Fe—Cr—Al-based, or the like, amorphous alloys such as amorphous alloys that are Fe-based, Co-based, or the like, spinel type ferrites such as ferrites that are Mg—Zn-based, Mn—Zn-based, Mn—Mg-based, Cu—Zn-based, Mg—Mn—Sr-based, Ni—Zn-based, or the like, hexagonal ferrites such as ferrites that are Ba—Zn-based, Ba—Mg-based, Ba—Ni-based, Ba—Co-based, Ba—Ni—Co-based, or the like, or garnet ferrites such as a Y-based ferrite, or the like.

The magnetic material may include a mixture of metal magnetic powder particles and a resin. The metal magnetic powder particles may include iron (Fe), chromium (Cr), or silicon (Si) as a main component. For example, the metal magnetic powder particles may include Fe—Ni, Fe, Fe—Cr—Si, or the like, but are not limited thereto. The resin may include epoxy, polyimide, liquid crystal polymer (LCP), or the like, or mixtures thereof, but is not limited thereto. The metal magnetic powder particles may be metal magnetic powder particles having two or more average particle sizes $D_1$ and $D_2$. In this case, bimodal metal magnetic powder particles having different sizes may be compressed and fully filled in a magnetic material-resin composite to increase a packing factor of the magnetic material-resin composite.

The body part 110 may be formed by molding the magnetic material-resin composite including the mixture of the metal magnetic powder particles and the resin in a sheet form, and stacking, compressing, and hardening the magnetic material-resin composite molded in the sheet form on upper and lower surfaces of the coil part 120. But the method of forming body part 110 is not limited thereto. The stacking direction of the magnetic material-resin composite may be the thickness direction and may be perpendicular to a mounting surface of the coil component, which may be the lower surface of body part 110. The term "perpendicular" includes a case where the angle between two components is approximately 90°, that is, 60° to 120°, as well where the angle is exactly 90°.

The electrode part 130 may electrically connect the coil component 100 to other components in an electronic device when the coil component 100 is mounted in the electronic device. The electrode part 130 may include first and second external electrodes 131 and 132 on the body part 110 and spaced apart from each other. The electrode part 130 may include, for example, a conductive resin layer and a conductor layer formed on the conductive resin layer. The conductive resin layer may include one or more conductive metals selected from the group consisting of copper (Cu), nickel (Ni), and silver (Ag), and a thermosetting resin. The conductor layer may include one or more selected from the group consisting of nickel (Ni), copper (Cu), and tin (Sn). For example, a nickel (Ni) layer and a tin (Sn) layer may be sequentially formed in the conductor layer. The shape of the electrode part 130 is not particularly limited. For example, as illustrated in FIG. 1, the electrode part 130 may include first and second electrodes 131 and 132 on respective end surfaces of the body part 110 and respectively extend on adjacent surfaces of the body part 110. The first and second electrodes 131 and 132 may also be only the respective end surfaces of the body part 110, or may be on respective end surfaces of the body part 110 and respectively extend on the lower surface of the body part 110 to each have an "L" shape.

The coil part 120 may include an insulating layer 121, first and second coil conductor layers 122*a* and 122*b*, and an encapsulant 124. A through-hole may be formed in a core region 115 of the coil part 120. The through-hole may be filled with a magnetic material the same as or different from that of the body part 110.

The insulating layer 121 may have a coil shape, may insulate the first and second coil conductor layers 122*a* and 122*b* from other components of the coil component 100, and may protect the first and second coil conductor layers 122*a* and 122*b* of the coil component 100. If coil conductors are provided in plural, such as the first and second coil conductors 122*a* and 122*b*, the insulating layer 121 may also insulate the plurality of coil conductors from one another.

In an existing thin film type inductor, a coil conductor may be formed on an insulating substrate such as a copper clad laminate (CCL). As such, the ability to reduce the overall thickness of the coil component is limited. When the insulating substrate becomes excessively thin (for example, about 60 μm or less), there is a risk of manufacturing defects due to rolling of the insulating substrate, damage to the insulating substrate, or the like. However, in the present disclosure, the coil conductor is disposed on an insulating layer rather than an insulating substrate Accordingly, the thickness of the coil part 120 may be significantly reduced. Therefore, miniaturization and thinning of the coil component 100 may be easily achieved. It will be apparent to those skilled in the art that a substrate is a base or support member on which one or more layers can be disposed, whereas a layer is a sheet of material disposed on a substrate or on another layer. According to the exemplary embodiment, the insulating layer 121 may have a thickness of 50 μm or less, and is preferably 40 μm or less. However, the thickness of the insulating layer 121 is not limited thereto. As the insulating layer 121 becomes thinner, the miniaturization and the thinning of the coil component 100 may be more easily achieved. Therefore, a lower limit of the thickness of the insulating layer 121 is not particularly limited, but may be 3 μm or more in order to provide appropriate rigidity to the coil part.

The material of the insulating layer 121 is not limited as long as it may block movement of electrons. For example, a thermosetting resin such as an epoxy resin, a thermoplastic resin such as polyimide, a resin having a reinforcing material such as an inorganic filler impregnated in the thermosetting resin or the thermoplastic resin, a polymer having insulating properties, or the like, may be used as the material of the insulating layer 121. For example, XBF, SR, polypropylene glycol (PPG), photoimagable dielectric (PID), perylene, or the like, available on the market may be used as the material of the insulating layer 121. However, the material of the insulating layer 121 is not limited thereto.

The first and second coil conductor layers 122*a* and 122*b* may have a coil shape corresponding to that of the insulating layer 121, and may be disposed on opposing surfaces of the insulating layer 121. In the present exemplary embodiment, a shape in which the coil conductor layers are formed on opposing surfaces of the insulating layer 121 in order to obtain a high level of inductance is illustrated. The first coil conductor layer 122*a* may be formed on one surface of the insulating layer 121, and the second coil conductor layer 122*b* may be formed on the opposing surface of the insulating layer 121. The first and second coil conductor layers 122*a* and 122*b* may be electrically connected to each other through via holes 125 penetrating through the insulating layer 121.

The first and second coil conductor layers 122*a* and 122*b* may be formed of a metal having high electrical conductivity, for example, silver (Ag), palladium (Pd), aluminum (Al), nickel (Ni), titanium (Ti), gold (Au), copper (Cu), platinum (Pt), or alloys thereof. An electroplating method may be used to manufacture the coil conductor 122 in a planar coil shape. Alternatively, other processes may be used as long as an effect similar to that of the electroplating method may be accomplished.

According to the exemplary embodiment, the coil part 120 may further include a seed layer 123*a* formed between one of the first and second coil conductors 122*a* and 122*b* and the insulating layer 121. In general, it is difficult to form coil conductors on an insulating layer by plating. Therefore, in order to easily form the coil conductors on the insulating layer, a seed layer is formed as a basic metal layer. However, as described below, in the present disclosure, one coil conductor may be formed before the insulating layer is formed, and may thus not have the seed layer 123*a*.

The encapsulant 124 may encapsulate the insulating layer 121 and the first and second coil conductor layers 122*a* and

122*b*, insulate the insulating layer 121 and the first and second coil conductor layers 122*a* and 122*b* from other components of the coil component 100, and serve to protect the first and second coil conductors 122*a* and 122*b*. The material of the encapsulant 124 is not limited as long as it may block movement of electrons. For example, a thermosetting resin such as an epoxy resin, a thermoplastic resin such as polyimide, a resin having a reinforcing material such as an inorganic filler impregnated in the thermosetting resin or the thermoplastic resin, a polymer having insulating properties, or the like, may be used as the material of the encapsulant 124. For example, XBF, SR, PPG, PID, perylene, or the like, available on the market, may be used as the material of the encapsulant 124. However, the material of the encapsulant 124 is not limited thereto.

According to the exemplary embodiment, the encapsulant 124 may fill spaces between the insulating layer 121 and adjacent patterns of the first and second coil conductor layers 122*a* and 122*b*. The encapsulant 124 may insulate the body part 110 and the first and second coil conductor layers 122*a* and 122*b* from each other to prevent deterioration of characteristics and effectively prevent the generation of deformation, or the like, of the coil conductors when manufacturing the coil component.

Figure 4:
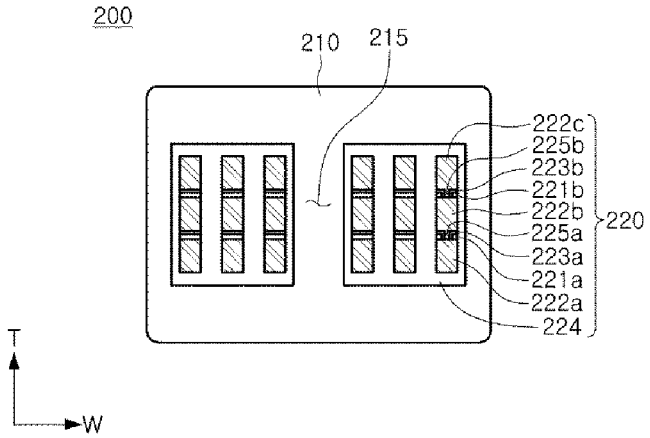
FIG. 4 is a cross-sectional view illustrating a coil component according to another exemplary embodiment in the present disclosure.

FIG. 4 is a cross-sectional view illustrating a coil component according to another exemplary embodiment in the present disclosure.

Referring to FIG. 4, in a coil component 200 according to another exemplary embodiment in the present disclosure, a coil part 220 may include a plurality of insulating layers 221*a* and 221*b* and a plurality of conductor patterns 222*a*, 222*b*, and 222*c*. The plurality of insulating layers 221*a* and 221*b* and the plurality of conductor patterns 222*a*, 222*b*, and 222*c* may be alternately stacked.

FIG. 4 illustrates a coil component 200 including the coil part 220 in which two insulating layers 221*a* and 221*b* and three conductor patterns 222*a*, 222*b*, and 222*c* are alternately stacked, but the numbers of insulating layers and conductor patterns are not limited thereto. There may be more than two insulating layers and may be more than three conductor patterns alternately stacked in the coil component 200. In the present exemplary embodiment, coil characteristics such as inductance, or the like, may be significantly improved.

FIGS. 5 through 8 are views illustrating a process of manufacturing the coil component of FIG. 3. Hereinafter, overlapping descriptions will be omitted, and a process of manufacturing the coil component will be described.

Figure 5:
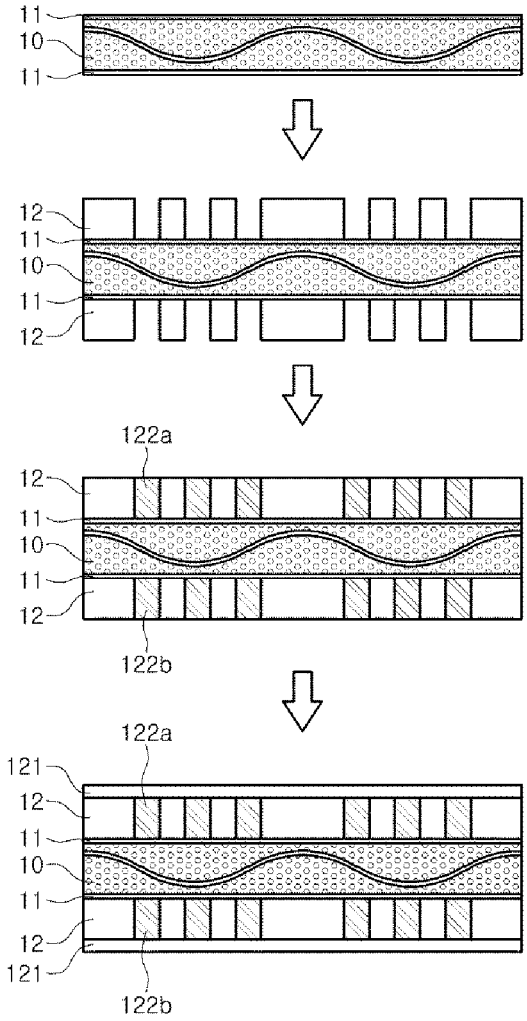
FIGS. 5 through 8 are views illustrating a process of manufacturing the coil component of FIG. 3.

Referring to FIG. 5, a support member 10 may first be prepared. The type of support member is not particularly limited, as long as it may provide appropriate rigidity to a coil part in a process of manufacturing the coil component. For example, the support member 10 may be a copper clad laminate (CCL). A metal layer 11 may be disposed on at least one surface of the support member 10, to allow the first coil conductor layer 122*a* to be more easily formed.

A first mask 12 having an opening pattern with a first coil shape may be formed on at least one surface of the support member 10. The first mask 12 may be formed by a photolithography method, but is not limited thereto. The material of the first mask 12 may be any photosensitive polymer that can be stripped after patterns are formed and selectively reacts to light. For example, the first mask may be a negative photo-resist or a positive photo-resist. The negative photo-resist may be a photosensitive polymer in which only a polymer of a portion (an exposed portion) in contact with light is insolubilized, such that only the polymer of the exposed portion remains after a development process. Exemplary negative photo-resists may include aromatic bis-azide, methacrylic acid ester, cinnamic acid ester, or the like, but the negative photo-resist is not limited thereto. The positive photo-resist may be a photosensitive polymer in which only a polymer of a portion (an exposed portion) in contact with light is solubilized, such that only a polymer of a non-exposed portion remains after a development process. Exemplary positive photo-resists may include polymethyl methacrylate, naphthoquinone diazide, polybutene-1 sulfone, or the like, but the positive photo-resist not limited thereto.

The first coil conductor layer 122*a* may be formed in the opening pattern of the first mask 12. The first coil conductor layer 122*a* may be formed by, for example, an electroless plating method using a dry film, an electroplating method, or the like, but is not limited thereto.

The insulating layer 121 may be formed on the first coil conductor layer 122*a*. The insulating layer 121 may be formed by a lamination method, but is not limited thereto, and may be formed by various methods such as a dipping method, a vapor deposition method, a vacuum deposition method, and the like.

Figure 6:
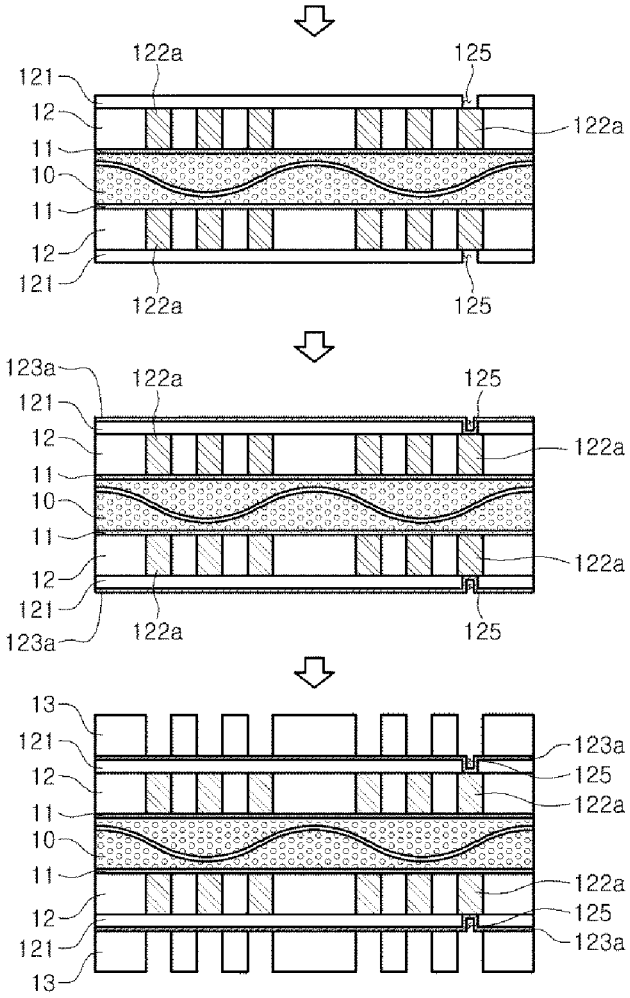

Referring to FIG. 6, vias penetrating through the insulating layer 121 may be formed in specific regions of the insulating layer 121. The vias may be later filled with conductors to constitute via holes 125. The via holes 125 may electrically connect the first and second coil conductor layers 122*a* and 122*b* formed, respectively, on opposing surfaces of the insulating layer 121. The via holes 125 may be formed using mechanical drilling, laser drilling, or the like, but are not limited thereto, and may be formed by various methods such as exposure, development, and stripping processes using a photosensitive material.

A seed layer 123*a* may be formed on the insulating layer 121. The seed layer 123*a* may facilitate the formation of the second coil conductor 122*b*. The seed layer 123*a* may be formed by a sputtering method, a spin method, a chemical copper plating method, or the like, but is not limited thereto.

A second mask 13 having an opening pattern with a second coil shape may be formed on the seed layer 123*a*. The second mask 13 may also be formed by a photolithograph method, but is not limited thereto. The second coil shape of the second mask 13 may be the same as, similar to, or different from the first coil shape of the first mask 12.

Figure 7:
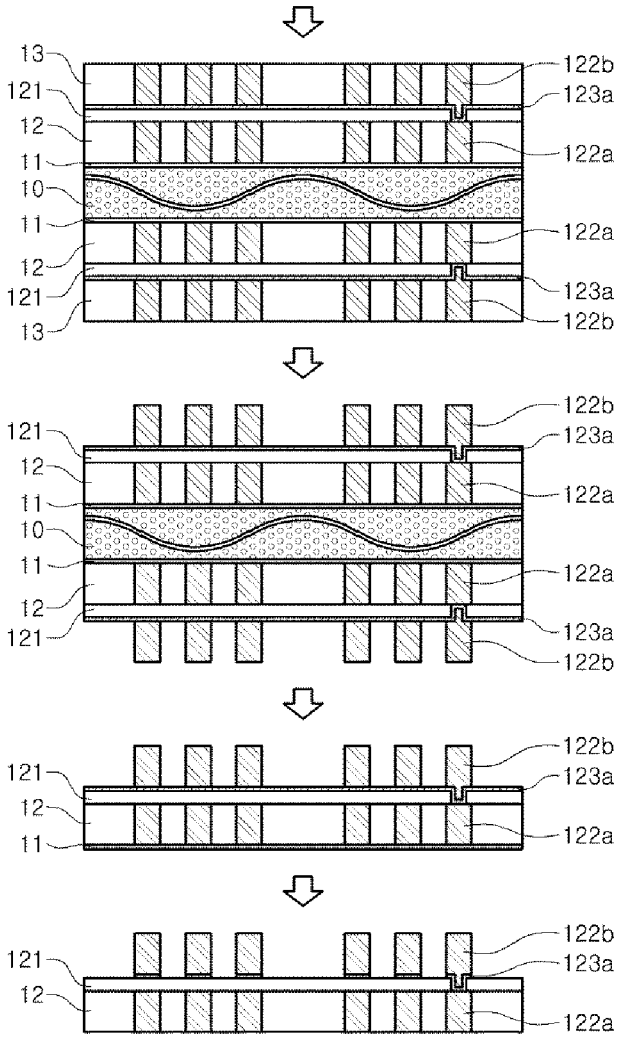

Referring to FIG. 7, the second coil conductor layer 122*b* may be formed in the opening pattern of the second mask 13. The second coil conductor layer 122*b* may also be formed by, for example, an electroless plating method using a dry film, an electroplating method, or the like, but is not limited thereto.

The second mask 13 may then be removed by, for example, stripping, etching, or the like, but is not limited thereto.

The first coil pattern layer 122*a* and the support member 10 may be separated from each other. If a metal layer 11 was disposed on the support member 10, the first coil pattern layer 122*a* and the support member 10 may be separated from each other by separating the support member 10 and the metal layer 11 formed on a surface of the support member 10 from each other.

Regions of the seed layer 123*a* corresponding to the second mask 13 may then be removed by, for example, etching, or the like, but is not limited thereto. If the metal layer 11 was disposed on the support member 10, the metal layer 11 may also be removed in this process.

Figure 8:
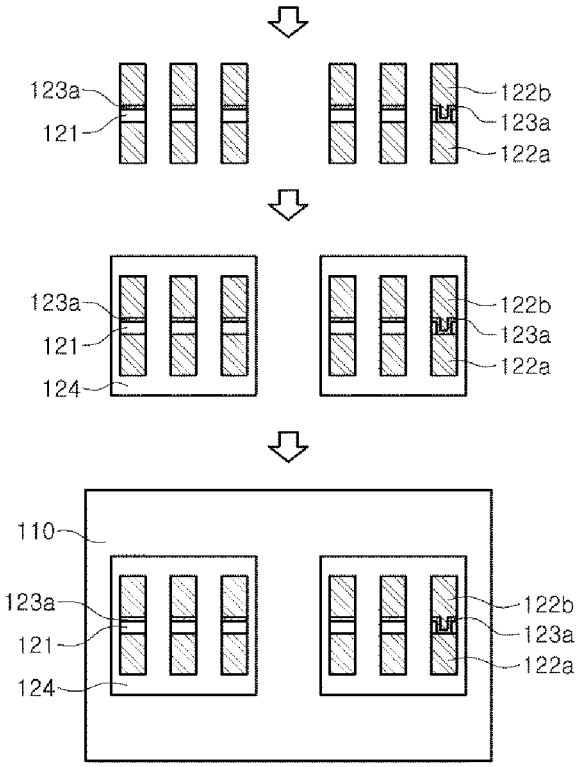

Referring to FIG. 8, the first mask 12 and regions of the insulating layer 121 corresponding to the first mask may be removed by, for example, stripping by $CO_2$ laser or UV laser, but is not limited thereto.

The encapsulant 124 encapsulating the insulating layer 121 and the first and second coil conductors 122*a* and 122*b* may be formed. The material of the encapsulant 124 may be, for example, XBF, SR, PPG, PID, perylene, or the like, but is not limited thereto, and may be other materials having insulating properties.

The body part 110 may then be formed. As described above, the body part 110 may be formed by stacking, compressing, and hardening the magnetic material-resin composite including the mixture of the metal magnetic powder particles and the resin, molded in the sheet form on the upper and lower surfaces of the coil part 120, but is not limited thereto.

As set forth above, according to the exemplary embodiments in the present disclosure, the coil conductor is not disposed on the insulating substrate, but is instead disposed on an insulating layer, such that the thickness of the coil component may be significantly reduced. Therefore, miniaturization and thinness of the coil component may be easily achieved.

While exemplary embodiments have been shown and described above, it will be apparent to those skilled in the art that modifications and variations could be made without departing from the scope of the present invention as defined by the appended claims.

What is claimed is:

1. A coil component comprising:

an insulating layer having a coil shape;

a first coil conductor layer on a surface of the insulating layer and a second coil conductor layer on an opposing surface of the insulating layer, each of the first and second coil conductor layers having a coil shape, corresponding to that of the insulating layer;

an encapsulant encapsulating the first and second coil conductor layers and the insulating layer; and a body part including a magnetic material and covering the encapsulant, wherein the magnetic material is spaced apart from the first and second coil conductor layers and the insulating layer by the encapsulant, and the encapsulant covers an upper surface of the first coil conductor layer and a lower surface of the second coil conductor layer, continuously extends from the upper surface of the first coil conductor layer to the lower surface of the second coil conductor layer, and is disposed in spaces between turns of the insulating layer and spaces between turns of the first and second coil conductor layers.

2. The coil component of claim 1, further including a seed layer between one of the first and second coil conductor layers and the insulating layer.

3. The coil component of claim 1, wherein the insulating layer has a thickness of 40 μm or less.

4. The coil component of claim 1, wherein the insulating layer includes one or more of the group consisting of perylene, epoxy, and polyimide.

5. The coil component of claim 1, wherein the body part is disposed above and below the encapsulant.

6. The coil component of claim 1, wherein the encapsulant, the first and second coil conductor layers, and the insulating layer have a through-hole in a core region of the first and second coil conductor layers, and the body part is disposed in the through-hole and covers outer surfaces of the encapsulant.

7. The coil component of claim 1, further comprising electrode parts disposed on the body part and electrically connected to the first and second coil conductor layers, respectively.

8. The coil component of claim 2, wherein the seed layer extends from one of the surfaces of the insulating layer into a via hole in which a via is disposed.

9. The coil component of claim 8, wherein side surfaces of the first and second coil conductor layers are in direct contact with the encapsulant.

* * * * *